United States Patent [19]

Di Rosa

[11] 4,122,778

[45] Oct. 31, 1978

[54] DAMPED SUSPENDED CONVEYOR TROLLEY

[75] Inventor: Getano Di Rosa, Pino Torinese (Turin), Italy

[73] Assignee: F.A.T.A - Fabbrica Apparecchi Di Sollevamento E Trasporto Ed Affint S.p.A., Turin, Italy

[21] Appl. No.: 798,560

[22] Filed: May 19, 1977

Related U.S. Application Data

[63] Continuation-in-part of Ser. No. 625,227, Oct. 23, 1975, abandoned.

[30] Foreign Application Priority Data

Jul. 4, 1975 [IT] Italy ..... 68736 A/75

[51] Int. Cl.[2] ..... B61B 3/00; B61B 9/00; B61B 13/00; B61F 13/00

[52] U.S. Cl. ..... 104/172 S; 104/94; 105/155; 198/477; 198/678

[58] Field of Search ..... 104/89, 94, 172 S, 178, 104/250; 105/148, 155; 198/477, 678

[56] References Cited

U.S. PATENT DOCUMENTS

| | | | |
|---|---|---|---|
| 2,039,473 | 5/1936 | Bennington | 104/89 X |
| 2,602,666 | 7/1952 | Burkeg et al. | 104/89 X |
| 2,973,721 | 3/1961 | Wagter | 104/178 X |
| 3,094,943 | 6/1963 | Parker et al. | 104/172 S |
| 3,353,498 | 11/1967 | Davis | 104/89 |
| 3,426,700 | 2/1969 | Klamp | 104/172 S |
| 3,487,789 | 1/1970 | Garner | 104/94 X |
| 3,720,172 | 3/1973 | Dehne | 104/172 S |

FOREIGN PATENT DOCUMENTS

| | | | |
|---|---|---|---|
| 163,489 | 7/1949 | Austria | 104/178 |
| 1,191,723 | 5/1970 | United Kingdom | 104/172 S |

*Primary Examiner*—Albert J. Makay
*Assistant Examiner*—Howard Beltran
*Attorney, Agent, or Firm*—Sughrue, Rothwell, Mion, Zinn and Macpeak

[57] ABSTRACT

A load carrier is supported on a guide rail by means of a front and rear trolley. The load carrier is pivotally connected to the front trolley by means of a pivoted rod and a shock absorber is interposed between the pivoted rod and the body of the front trolley.

1 Claim, 13 Drawing Figures

DAMPED SUSPENDED CONVEYOR TROLLEY

CROSS-REFERENCE TO RELATED APPLICATION

The present application is a continuation-in-part of application Ser. No. 625,227, filed Oct. 23, 1975 and now abandoned.

The present invention relates to aerial conveyors of the double track type.

In the present specification the term "aerial conveyor of the double track type" refers to conveyors of the type comprising:

(a) an upper rail carrying support trolleys to which a drive chain is connected, pusher dogs (hereinafter referred to as "pushers" for the sake of brevity), being carried by the chain or by the support trolleys;

(b) a pair of lower rails supporting load carrying elements including trolleys arranged to be driven by the pushers of the drive chain.

Each load carrying element in such an aerial conveyor comprises:

a single or a train of interconnected trolleys (sometimes referred to as a yoke) formed by a front trolley, a rear trolley and possibly intermediate trolleys, the number of which will vary according to the load to be carried;

a load container, which can be carried directly by a lower attachment element (in the case of conveyors provided with single trolleys), or by a load carrying bar which interconnects the lower attachment elements of one or more trolleys of a train of trolleys. In this latter case the first of the load carrying trolleys (in the direction of advance of the trolley) can be driven directly by the drive chain or an additional trolley can be provided having only a driving function, the lower attachment element of which is connected, through a tow bar, to the lower attachment element of the first of the load carrying trolleys.

The front trolley of each train or "yoke" is provided at its upper end with means adapted to cooperate with one of the pushers of the chain for the purpose of propelling or braking (holding back) the train. Such means normally comprise a drive dog and a braking or hold back dog.

The rear trolley of each train or yoke is provided on its rear part with a disengagement appendix which serves to release the drive dog of the front trolley of a following train from a pusher of the drive chain when the two trolleys come into contact.

Along the path of the trolleys of such a train, stopping devices (also known as blocking devices) are provided, each comprising a movable element which, when moved to its operative position, acts on the drive dog of the leading trolley to disengage it from the dog of the chain and consequently cause the stopping of the train.

Two track conveyors of the type referred to are subjected to dynamic stresses or shocks due to successive starts and stops dictated by the working requirements or by the operation of the conveyor.

Such shocks occur particularly in the following working conditions:

between the leading trolley of a train or yoke and stopping or blocking devices;

between the leading trolley of a train or yoke and the rear trolley of the preceding train or yoke when the latter is stopped;

between the drive dog of the leading trolley of a train or yoke and a pusher carried by the drive chain upon starting of the train or yoke.

Various solutions have been proposed to avoid the aforementioned difficulties, including:

(a) increasing the space which the leading trolley must move through between the moment of disengagement from the pusher and the moment of stopping by mechanical contact with the rear trolley of the preceding train or yoke;

(b) keeping the speed of the conveyor to the lowest values possible, compatible with the requirements of use, such as the speed of a production line;

(c) mounting the means of stopping or blocking upon resilient supports (a solution which solves only the stopping problem but not that of the starting) and similarly mounting upon resilient supports the means of disengagement between the successive trains;

(d) suspending a load container in such a manner that it can oscillate with respect to the means of connection between the trolleys of a train or yoke.

All these proposed solutions share the common characteristic that kinetic energy is absorbed in the form of an elastic deformation of the various components of the conveyor, such as the chain, the trolleys, or a coupling bar. Because such components are not capable of dissipating energy it is not possible to exceed a certain load or speed without resorting to increasingly heavy conveyors. Moreover, the transport of loads which can be damaged by shocks or impacts is not possible except at very low speeds, unless resort is had to expensive loading arrangements, such as the packing of the loads with soft packing materials.

Present-day production requirements frequently call, however, for conveyors in which each train must start and stop on average every 20 to 30 seconds and conveyors on which the load on each train or yoke exceeds 2000 kg.; such requirements tend to become more demanding, as a result of which the above mentioned solutions to avoid the undesirable effects of impacts and shocks in the operation of two track conveyors are incapable of satisfying current market requirements.

In two track conveyors in which each train or yoke is provided with leading drive trolley which does not contribute to the support of the load and is connected to the following trolley by means of a tow bar it has already been proposed (U.S. Pat. No. 3,720,172) to embody this tow bar in the form of a telescopic element which incorporates a piston and cylinder type damper or shock absorber. This solution does not solve the problem which is fundamental to the present invention, since it would not be obviously applicable to conveyor trains not provided with a tow bar and since in many cases, for constructional reasons, the tow bar must be of a form and disposition which does not permit the incorporation thereon of a telescopic damper.

Furthermore, in such arrangements having a tow bar incorporating a damper, the damper or shock absorber would be prone to damage, being exposed to the impacts to which the tow bars are subjected during the operation of the conveyor, which could cause deformation of the bar such as to spoil the alignment between the piston and cylinder of the associated damper or shock absorber, preventing sliding movement between these two parts. The dismounting of the damper or shock absorber for maintenance operations would require, in such an arrangement, the complete replacement of the two bar inasmuch as the damper or shock absorber forms part of the means coupling the leading trolley to the following trolley, and is therefore an essential component of the train.

Another earlier proposal, described in U.S. Pat. No. 2,973,721, is a conveyor having two superimposed tracks with single load carrying trolleys moving on the lower track, each trolley being provided with a plate which is slidable axially against the action of springs, the plate forming an abutment for engagement by a pusher carried by the drive chain supported by the upper track. This solution also fails to solve the problem which is fundamental to the present invention, inasmuch as the springs oppose only the acceleration forces imparted to the trolleys by the drive chain, but not the forces of deceleration which occur upon stopping of the trolleys by stops or blocking devices, since the load is suspended from means which are rigidly fixed to the frame of the trolley. Furthermore, the absence of energy dissipating devices in this known device creates a condition in which the stored energy released by the springs during acceleration of the trolley gives rise to jolts in the initial movement of the trolley.

An object of the present invention is to avoid the aforementioned difficulties by providing a load carrier for a two track aerial conveyor which is capable of absorbing shocks and impacts.

According to the invention there is provided a load carrier for aerial conveyors of the double rail type comprising load carrying means, front trolley means and rear trolley means operably connected to said load carrying means and shock absorbing means mounted on said front trolley means for dissipating kinetic energy associated with the starting and stopping of the load carrier, said front trolley means comprising a body, a rod pivoted at one end to said body and pivotally connected at the other end to said load carrying means and said shock absorbing means connected at one end to said body and at the other end to said rod adjacent the said other end of said rod, said shock absorbing means extending substantially along the direction of movement of the load carrier.

The load carrier according to the invention provides efficient damping of shocks and impacts and can be used in aerial conveyors of the two track type, both where the load carrying element comprises a train or yoke formed by at least two trolleys interconnected by a load carrying beam in which the leading load carrying trolley also acts as a driving trolley to tow the train, and where the leading load carrying trolley is connected by a tow bar to a separate front driving trolley. The invention is also applicable to the case where the load carrying element comprises a single trolley.

The invention will be further described, by way of example, with reference to the accompanying drawings, in which.

Figure 1:
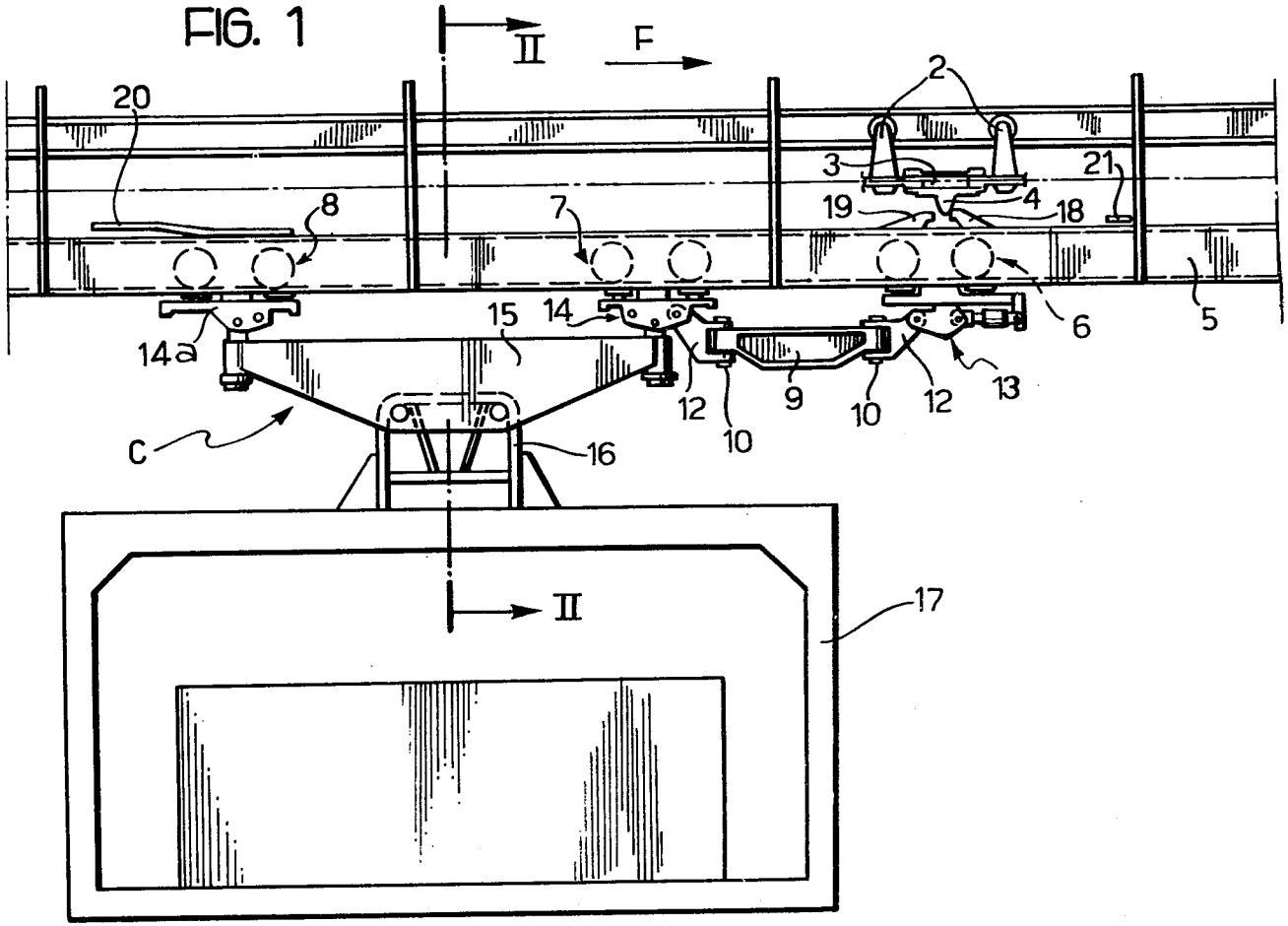
FIG. 1 is a side elevation of a part of a double track aerial conveyor provided with load carrier according to one embodiment of the invention.
Figure 2:
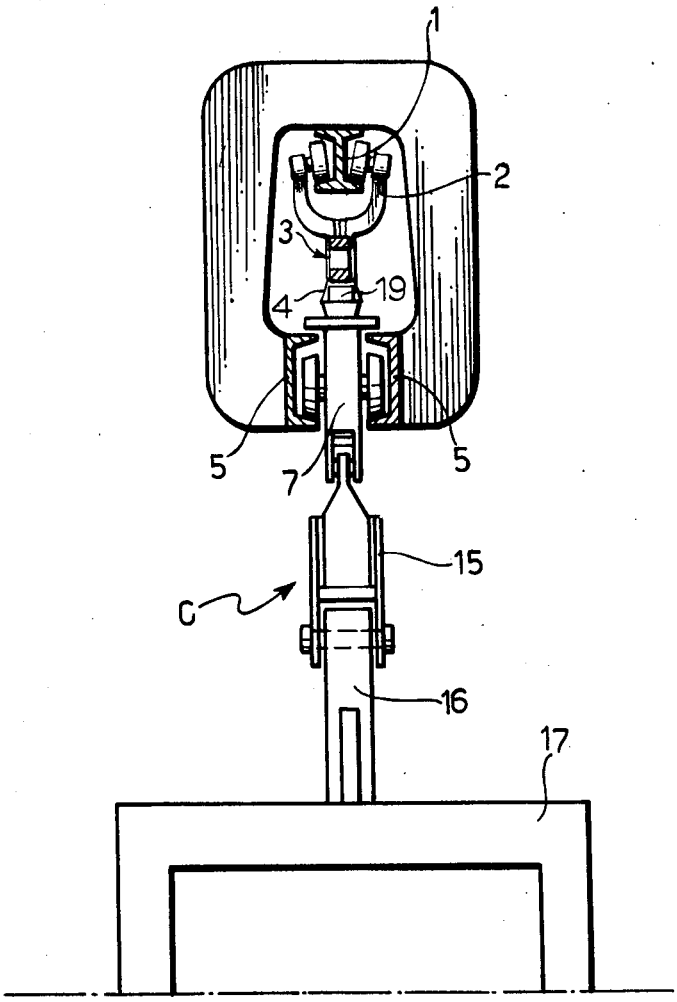
FIG. 2 is a transverse cross section taken along line II—II of FIG. 1.

Referring first to FIGS. 1 to 5, reference numeral 1 indicates the upper horizontal track of a two track aerial conveyor having upper tracks along which run trolleys 2, one only of which is shown in the drawings. The trolleys 2 support and guide a drive chain 3 provided with pushers 4. The conveyor also has a lower track comprising a pair of lower horizontal rails 5 which support and guide load carriers, one of which is shown in the drawing and is indicated generally by C.

Each load carrier C comprises a series of trolleys running on the rails 5 in the direction of the arrow F. This series of trolleys comprises a front driving trolley 6, and two load carrying trolleys, comprising an intermediate trolley 7 and a rear trolley 8.

A coupling bar 9 interconnects the trolleys 6 and 7. The two ends of the coupling bar 9 are articulated, by means of vertical pivot pins 10 to fork elements 12, the front one of which is pivotally connected to an attachment element 13 carried by the driving trolley 6 and the rear one of which is pivotally connected to an attachment element 14 carried by the intermediate trolley 7. The axes of the two pivot pins 10 are perpendicular to the axes of the trolley wheels and to the direction of movement of the conveyor while the pivotal connections of the fork elements 12 to the attachment elements 13, 14 have axes which are perpendicular to the plane containing the axes of the pivot pins 10.

An attachment element **14*a* is carried by the rear trolley 8. The two attachment elements 14 and 14*a* of the trolleys 7 and 8 are interconnected by plates forming a load carrying beam 15 to the centre of which is connected a support 16 carrying a load container 17**.

The front driving trolley 6 is provided with an upstanding drive dog 18 and an upstanding hold-back dog 19 both of which are arranged to cooperate with the pushers 4 carried by the drive chain 3, one of the pushers 4 being interposed between the dogs 18, 19 so that when the pusher 4 engages the drive dog 18 the load carrying element C is driven forwards and when the pusher 4 engages the holdback dog 19 the load carrying element C is held back or stopped.

The rear trolley 8 of the train constituted by the three interconnected trolleys 6, 7 and 8 is provided at its rear part with an upstanding disengagement cam 20, in the form of a ramp, the purpose of which is to release the drive dog 18 of the leading trolley of a succeeding train from a cooperating pusher of the drive chain 3 when two trolleys come into contact.

In the path of travel of the trolleys at a selected position a stop 21 is provided which, when moved into its operative position, acts on the drive dog 18 of the leading trolley 6 to disengage it from the pusher 4 and cause the train to stop.

The attachment elements 14 and 14*a* of the intermediate and rear trolleys 7 and 8 respectively are rigidly fixed to the frames of the respective trolleys in a conventional manner, whilst the attachment element 13 is supported by the frame of the drive trolley 6 in such a manner that it can be displaced longitudinally relative to the trolley 6.

Figure 3:
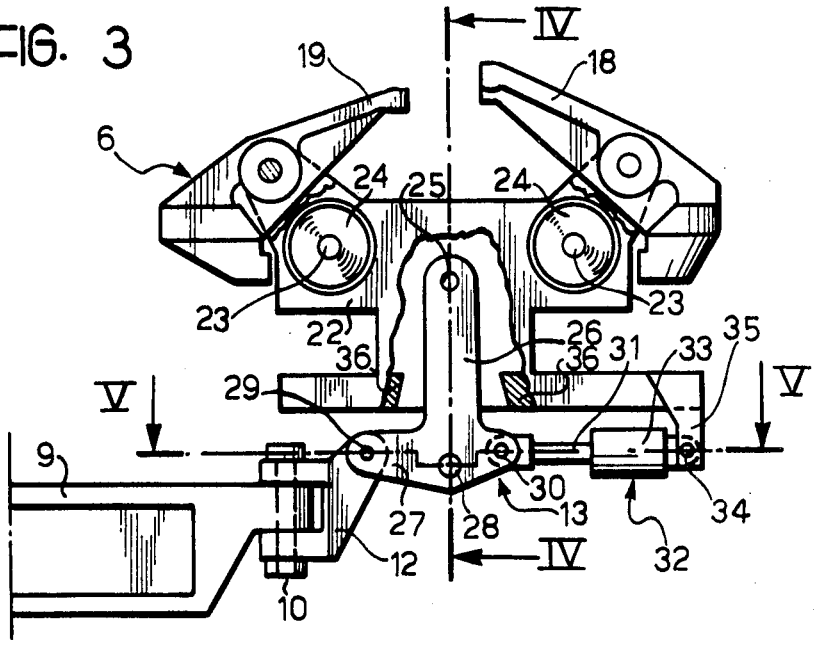
FIG. 3 is an enlarged detail of the leading trolley of the train of the load carrier illustrated in FIG. 1, FIGS. 4 and 5 are cross sections taken respectively along the lines IV—IV and V—V of FIG. 3.
Figure 4:
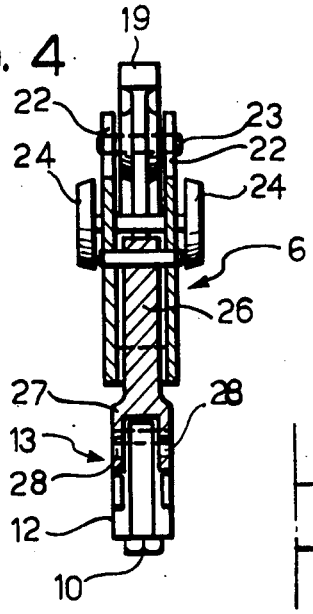
Figure 5:
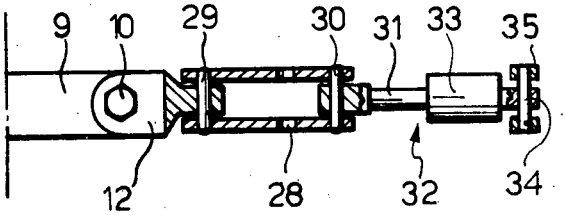

As illustrated in FIGS. 3 to 5, the front drive trolley 6 has a frame formed by two vertical plates 22 between which are supported the axles 23 of a front and a rear pair of trolley wheels 24. Between the plates 22 the attachment element 13 is mounted for pivotal movement pendulum-fashion about an upper pin 25 parallel to the axles 23 of the wheels 24. The attachment element 13 comprises a lever arm 26 in the form of a flat shank having a bifurcated lower part 27 which is elongated in the direction of conveyor movement, that is, longitudinally.

The lower part 27 of the lever arm 26 is provided with three pairs of holes aligned in a direction parallel to the axis of the pivot pin 25, as follows:

a first pair of centrally located holes 28 serving for the suspension of a load (not shown in the drawing) when the trolley 6 is used individually or, alternatively, as will be shown later, for the articulation of a vertical suspension bar in the case where the trolley 6 is used as the first trolley of a pair of load-carrying trolleys;

a second pair of holes, located rearwardly with respect to the direction of travel, supporting a pivot pin 29 of one of the fork elements 12 to which the coupling bar 9 is articulated by means of one of the pivot pins 10;

a third pair of holes, disposed at the front of the lower part 27, supporting a pivot pin 30 for the pivotal attachment of the free end of a piston rod 31 of a telescopic damper 32 extending parallel to the direction of conveyor movement, that is, horizontally. The damper 32 has a cylinder 33 one end of which is articulated about a pin 34 supported by a pair of plates 35 attached to the frame 22.

The damper 32 is constructed in a conventional manner to function as an energy dissipator or shock absorber, for example, by causing flow of an hydraulic fluid contained in the cylinder 33 from one side to the other of the piston attached to the rod 31, when a relative displacement takes place between the rod 31 and the cylinder 33. Such displacement occurs upon sudden acceleration of the train, by virtue of the inertia of the attachment element 13 and of the bodies connected to it by means of the pin 29, which causes a clockwise rotation of the attachment element 13 about its pivot pin 25, resulting in elongation of the telescopic damper 32. Upon sudden deceleration of the train, the inertia of these bodies causes an anticlockwise rotation of the attachment element 13, with consequent shortening of the telescopic damper 32.

The angular travel of the attachment element 13 is limited by stops 36 carried by the frame 22 of the trolley 6 so as not to cause damage to the damper 32.

FIGS. 6 to 9 illustrate the application of a trolley 66, identical to the trolley 6 illustrated in FIGS. 3, 4 and 5, to a train formed by only two trolleys, of which the trolley 66 is the leading trolley and a trolley 88, of conventional type, forms the rear trolley. In FIGS. 6 to 9 components corresponding to those of FIGS. 1 to 5 are indicated by the same reference numerals.

In this embodiment, use is made of the central holes of the bifurcated lower part 27 of the pendulum lever arm 26 to attach, by means of a pivot pin 36, a pin 37 on which is rotatingly mounted, in a conventional manner, the front end a load carrying beam 38, pivotally connected at its other end by means of a similar pin to the attachment element 14*a* fixed to the frame of the rear trolley 88.

The operation of the telescopic damper 32 upon acceleration and upon deceleration of the conveyor is identical to that of the damper 32 in the embodiment illustrated in FIGS. 1 to 5.

Figure 6:
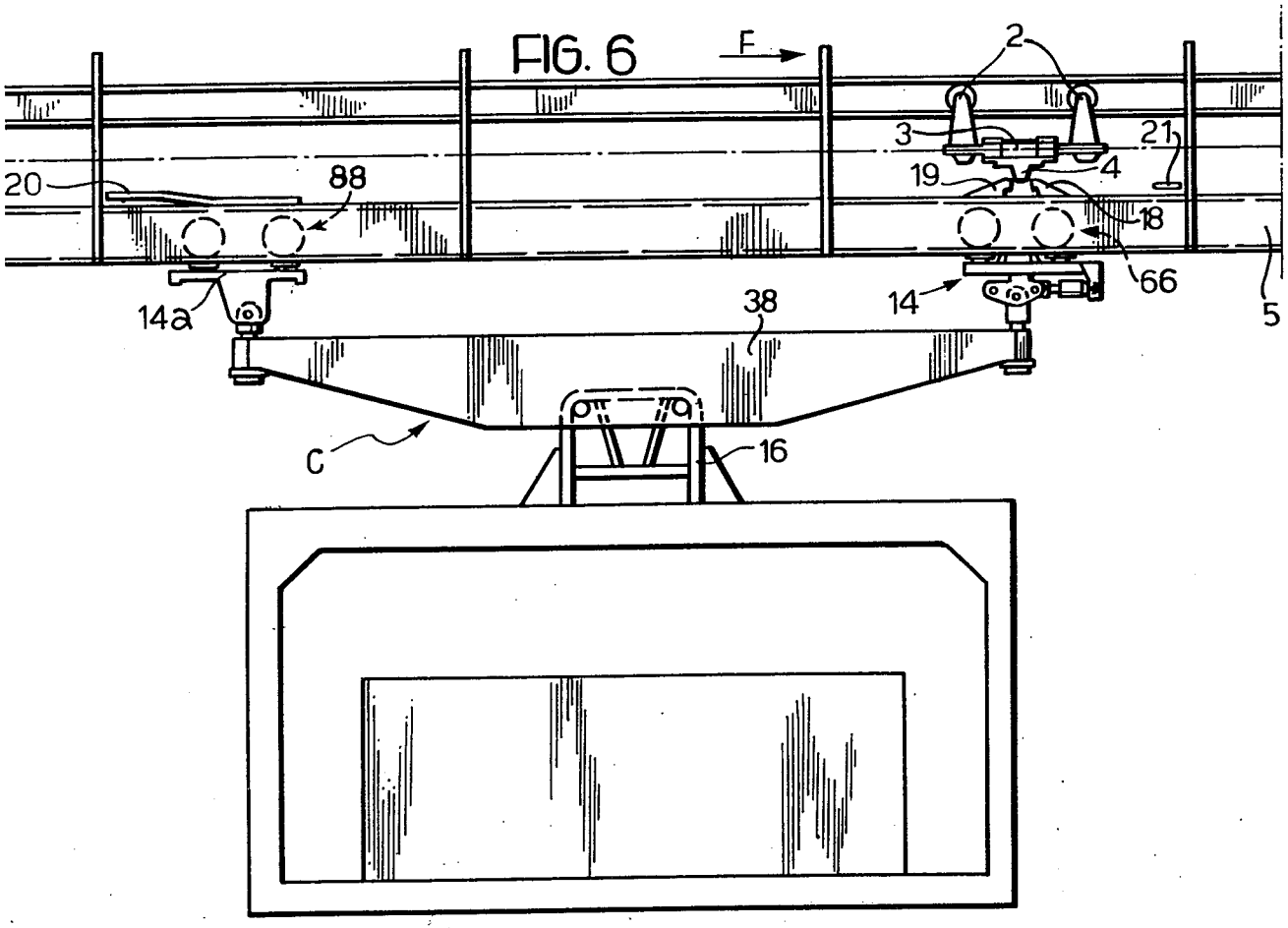
FIG. 6 is a side elevation of a part of a conveyor provided with a variant of the load carrier shown in FIG. 1.
Figure 7:
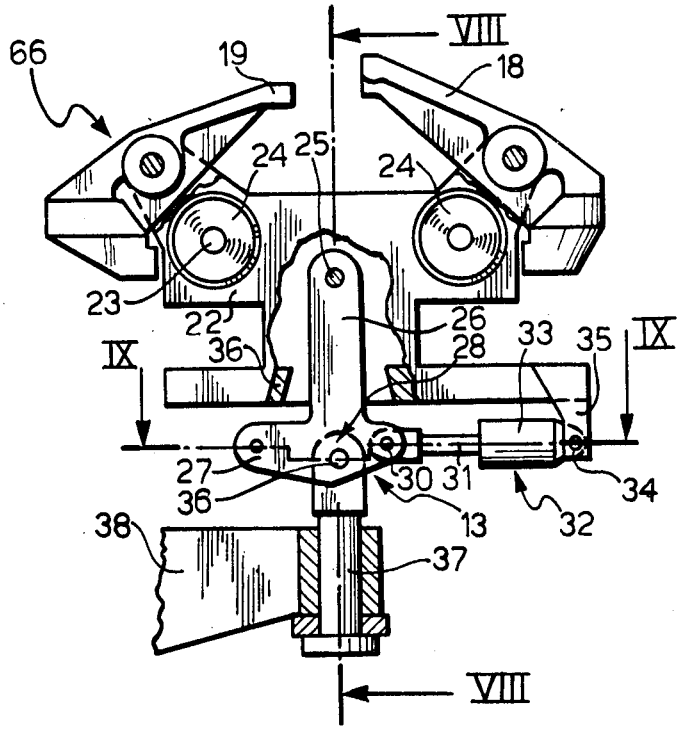
FIG. 7 is an enlarged detail of the front trolley of a train of a load carrier on the conveyor illustrated in FIG. 6.
Figure 8:
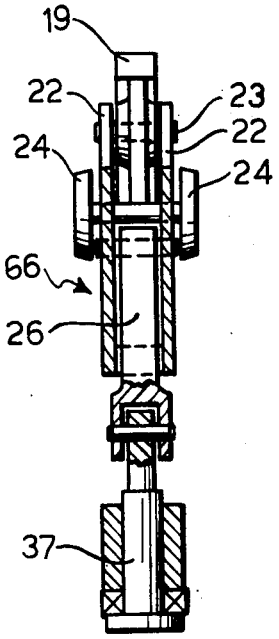
FIGS. 8 and 9 are cross sections taken respectively along the lines VIII—VIII and IX—IX of FIG. 7.
Figure 9:
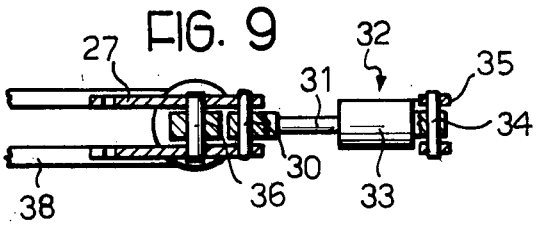
Figure 11:
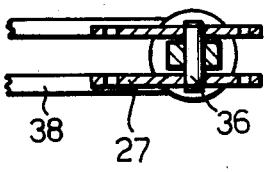
FIG. 11 is a cross section taken along the line XI—XI of FIG. 10.
Figure 10:
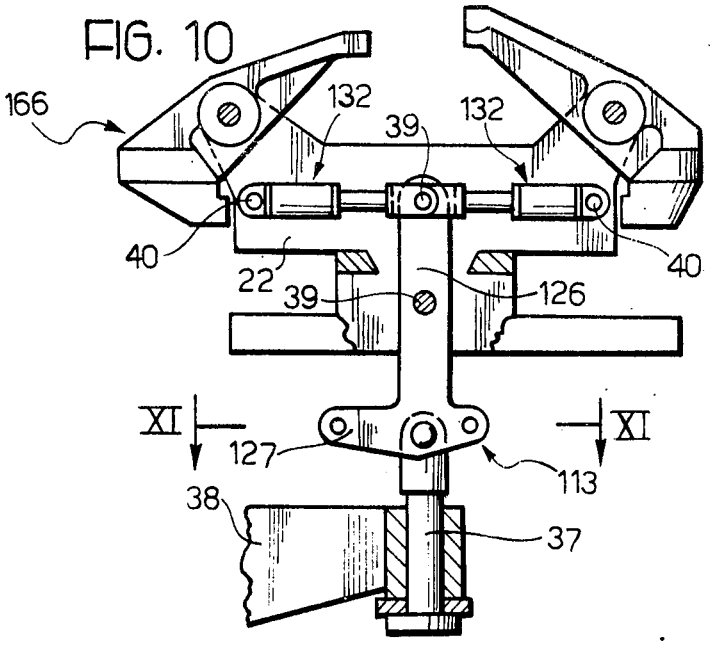
FIG. 10 is a front elevation of a leading trolley forming part of a load carrier according to a further embodiment of the invention.

The variant illustrated in the FIGS. 10 and 11 has a trolley 166 used, in an identical manner to the trolley 66 of FIGS. 6 and 7, as a leading trolley of a conveyor train formed by two load-carrying trolleys, but which could also be used as a drive trolley, in the same manner as the trolley 6 in the embodiment of FIG. 1.

The trolley 166 has an attachment element 113 which differs from the attachment element 13 of the previously described embodiments in that it comprises a flat shank 126 with a bifrucated lower part 127 hinged to the frame 22 of the trolley 166 at an intermediate point. At its upper end the shank 126 is articulated by means of a pivot pin 39 to the adjoining ends of two telescopic dampers 132 horizontally opposed to each other, the other ends of which are pivotally connected to the frame 22 by means of pins 40.

In this variant the two telescopic dampers 132 work in opposition, that is to say, by the effect of the pivotal movement of the shank 126 due to the forces of inertia during acceleration or deceleration, which causes one damper 132 to elongate while the other shortens.

Figure 12:
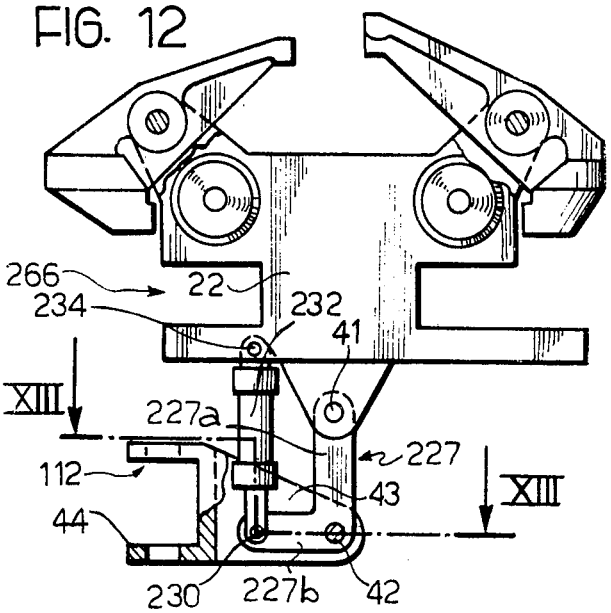
FIG. 12 is a side elevation of a conveyor trolley forming part of a load carrier according to a further embodiment of the invention.
Figure 13:
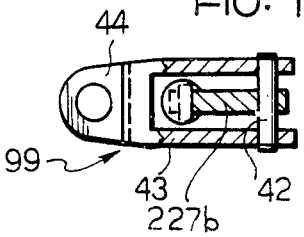
FIG. 13 is a cross section taken along the line XIII—XIII of FIG. 12.

The variant illustrated in FIGS. 12 and 13 has a front trolley 266 supporting a pivoted attachment element 227 formed by a right-angled lever having an upstanding arm 227*a*, shown vertical in FIG. 12, the upper end of which is articulated by means of a pin 41 to the frame 22 of the trolley 266 and a horizontally directed arm 227*b* articulated by means of a pin 230 to the lower end of a vertically orientated telescopic damper 232 the upper end of which is articulated by means of a pin 234 to the frame 22. At the elbow of the right-angled lever 227 a front bifurcated part 43 of a fork element 112 is pivotally attached by means of a pin 42, the bifurcated part 43 embracing the lower end of the damper 232. The fork element 112 has a forked rear part serving, as in the case of the fork element 12 described with reference to FIGS. 1 to 3, for the articulation of a coupling bar interposed between the trolley 266 and the succeeding trolley of a train.

The operation of this embodiment is identical to that described with reference to the embodiment of FIGS. 1 to 4.

Illustrations have been given of load carrying elements of the type described in, for example, the Applicants' U.K. patent specification No. 1,191,723, in which the disengagement cam (illustrated at 20 in FIG. 1), which serves to release the driving dog of a succeeding load carrying element upon contact with a leading element, is disposed above the pair of lower tracks of the conveyor and has a substantially horizontal part to engage the upper side of the said driving dog. It will, however, be evident that the present invention is also applicable to load carrying elements of two track aerial conveyors of other types.

The invention has been described for the sake of convenience in its application to a horizontal conveyor, and references to "horizontal" and "vertical" should be construed accordingly: it will be clear, however, that the load carrying elements of the invention are equally applicable to two track aerial conveyors having tracks which are not strictly horizontal.

It will be understood that details of construction of practical embodiments of the invention can be widely varied with respect to what has been described and illustrated, without, however, departing from the scope of the present invention.

I claim:

1. A load carrier for aerial conveyors of the double rail type comprising load carrying means, front trolley means and rear trolley means operably connected to said load carrying means and shock absorbing means mounted on said front trolley means for dissipating kinetic energy associated with the starting and stopping of the load carrier, said front trolley means comprising a body, a rod pivoted at one end to said body and pivotally connected at the other end to said load carrying means and said shock absorbing means connected at one end to said body and at the other end to said rod adjacent the said other end of said rod, said shock absorbing means extending substantially in the plane of the direction of movement of the load carrier; said rod being in the form of a right-angled lever having an upstanding vertical arm hinged at its upper end to the body of the trolley for pivotal movement about a horizontaly axis perpendicular to the direction of displacement of the trolley and said shock absorbing means comprising a telescopic damper interposed between the end of a lower substantially horizontal arm of the lever and the body of the trolley, the elbow region at the junction of the two arms of the lever being pivotally connected to said load carrying means.

* * * * *